US006729093B2

(12) United States Patent
Zambelli et al.

(10) Patent No.: US 6,729,093 B2
(45) Date of Patent: May 4, 2004

(54) PREFABRICATED CONCRETE PANEL FOR INDUSTRIALIZED BUILDING WITH HIGH THERMAL AND/OR ACOUSTIC INSULATION

(76) Inventors: Sergio Zambelli, Via Stezzano 28, 24050 Zanica (IT); Benito Zambelli, Via Roma 44, 24050 Zanica (IT)

( * ) Notice: Subject to any disclaimer, the term of this patent is extended or adjusted under 35 U.S.C. 154(b) by 0 days.

(21) Appl. No.: 09/742,561

(22) Filed: Dec. 22, 2000

(65) Prior Publication Data

US 2001/0015040 A1 Aug. 23, 2001

(30) Foreign Application Priority Data

Feb. 18, 2000 (IT) ..... MI2000A0298

(51) Int. Cl.[7] ..... E04C 2/26
(52) U.S. Cl. ..... 52/405.1; 52/411; 52/223.6
(58) Field of Search ..... 52/405.1, 223.6, 52/320, 411, 503, 576; 181/210, 286

(56) References Cited

U.S. PATENT DOCUMENTS

| | | | | | |
|---|---|---|---|---|---|
| 1,978,473 | A | * | 10/1934 | Novambere | 72/16 |
| 2,132,832 | A | * | 10/1938 | Prive | 72/46 |
| 2,602,322 | A | * | 7/1952 | Preble et al. | 72/32 |
| 3,000,144 | A | * | 9/1961 | Kitson | 50/268 |
| 3,295,278 | A | * | 1/1967 | Muhm | 52/223 |
| 3,334,458 | A | * | 8/1967 | Leemhuis | 52/223 |
| 3,382,637 | A | * | 5/1968 | Longinotti | 52/320 |
| 3,826,052 | A | * | 7/1974 | Tenorio | 52/293 |
| 3,908,323 | A | | 9/1975 | Stout | |
| 3,999,341 | A | * | 12/1976 | Stout | 52/221 |
| 4,425,981 | A | * | 1/1984 | Kiesewetter et al. | 181/286 |

FOREIGN PATENT DOCUMENTS

| | | |
|---|---|---|
| DE | 30 09 378 | 9/1981 |
| EP | 0 591 849 | 4/1994 |
| EP | 0 955 421 | 11/1999 |

* cited by examiner

*Primary Examiner*—Brian E. Glessner
*Assistant Examiner*—Basil Katcheves
(74) *Attorney, Agent, or Firm*—Guido Modiano; Albert Josif; Daniel O'Byrne

(57) ABSTRACT

A prefabricated concrete panel for industrialized building, with high thermal and/or acoustic insulation, comprising a first sheet and a second sheet which are embedded in the concrete body of the panel and face each other on planes which are parallel to the planes of arrangement of the two larger faces of the panel. At least one of the sheets is made of thermally insulating material and the sheets delimit, therebetween, an air chamber which is divided into a plurality of mutually connected recesses in order to increase thermal and/or acoustic insulation of the panel.

18 Claims, 4 Drawing Sheets

PREFABRICATED CONCRETE PANEL FOR INDUSTRIALIZED BUILDING WITH HIGH THERMAL AND/OR ACOUSTIC INSULATION

BACKGROUND OF THE INVENTION

The present invention relates to a prefabricated concrete panel for industrialized building with high thermal and/or acoustic insulation, intended particularly but not exclusively for use in providing faces of civil or industrial buildings.

Prefabricated concrete panels, particularly infilling panels, internally embedding a sheet of foamed polystyrene shaped like a parallelepiped and designed to lighten the panel and reduce its thermal conductivity, are known and used in industrialized building.

These conventional panels have thermal expansion problems which must be solved during design and installation resorting to adequate systems for compensating the expansion or contraction of the panel following weather changes.

Moreover these panels quite often have a thermal insulation effect which is not fully satisfactory, forming condensation on the inner side of the panel. In order to solve this problem, in the conventional manufacturing technique, a cavity is usually formed between the panel and the internal space of the building, utilizing the cavity both as an additional thermal insulation layer and as a chamber through which moisture can be removed so as to avoid formation of condensation on the inside walls of the building.

A solution of this kind, besides failing to fully solve the problem, leads to other problems, such as for example the fact that the overall thickness of the outer walls of the building is increased considerably, reducing the useful volume of the building for an equal outside volume.

Moreover, these panels achieve only a reduced degree of soundproofing.

In order to solve these problems, a prefabricated concrete infilling panel has been proposed and is disclosed in Italian patent 1,266,604 by the same Applicants; such panel comprises a sheet which is embedded in the concrete body of the panel and is contoured so as to form, inside the panel, an air chamber which is interposed between the two larger faces of the panel, so as to achieve a high thermal and acoustic insulation effect for the panel.

Over the years, this type of panel has proved to be susceptible of improvements aimed mainly at further increasing its thermal and/or acoustic insulation effect.

SUMMARY OF THE INVENTION

The aim of the present invention is to provide a prefabricated concrete panel for industrialized building which achieves an even higher thermal and/or acoustic insulation effect than that obtainable with currently commercially available prefabricated panels.

Within the scope of this aim, an object of the invention is to provide a prefabricated panel in which it is possible to achieve, during manufacture, high precision in the positioning of the various elements that compose it.

Another object of the invention is to provide a prefabricated panel in which the reinforcement has an increased bonding with the concrete.

Another object of the invention is to provide a panel which solves the problem of the formation of condensation without requiring the presence of a cavity between its inner side and the inside wall of a building, so as to obtain, in addition to a reduction in building costs, a better utilization of the volume of a building.

Another object of the invention is to provide a panel which can dissipate heat in order to avoid overheating and can have thermal expansions which are reduced or at least evenly distributed along its extension.

This aim and these and other objects which will become better apparent hereinafter are achieved by a prefabricated concrete panel for industrialized building, with high thermal and/or acoustic insulation, characterized in that it comprises a first sheet and a second sheet which are embedded in a concrete body of the panel and face each other on planes which are parallel to planes of arrangement of two larger faces of the panel, at least one of said sheets being made of thermally insulating material, said sheets delimiting, therebetween, an air chamber in order to increase thermal and/or acoustic insulation of the panel, said first sheet being shaped so as to form cups which are laterally adjacent to each other and delimit concave recesses on a face of said first sheet facing the second sheet, a side of said recesses that is directed toward said second sheet being closed by said second sheet and said recesses being connected to each other.

BRIEF DESCRIPTION OF THE DRAWINGS

Further characteristics and advantages of the invention will become better apparent from the description of a preferred but not exclusive embodiment of the panel according to the invention, illustrated only by way of non-limitative example in the accompanying drawings, wherein.

DESCRIPTION OF THE PREFERRED EMBODIMENTS

Figure 1:
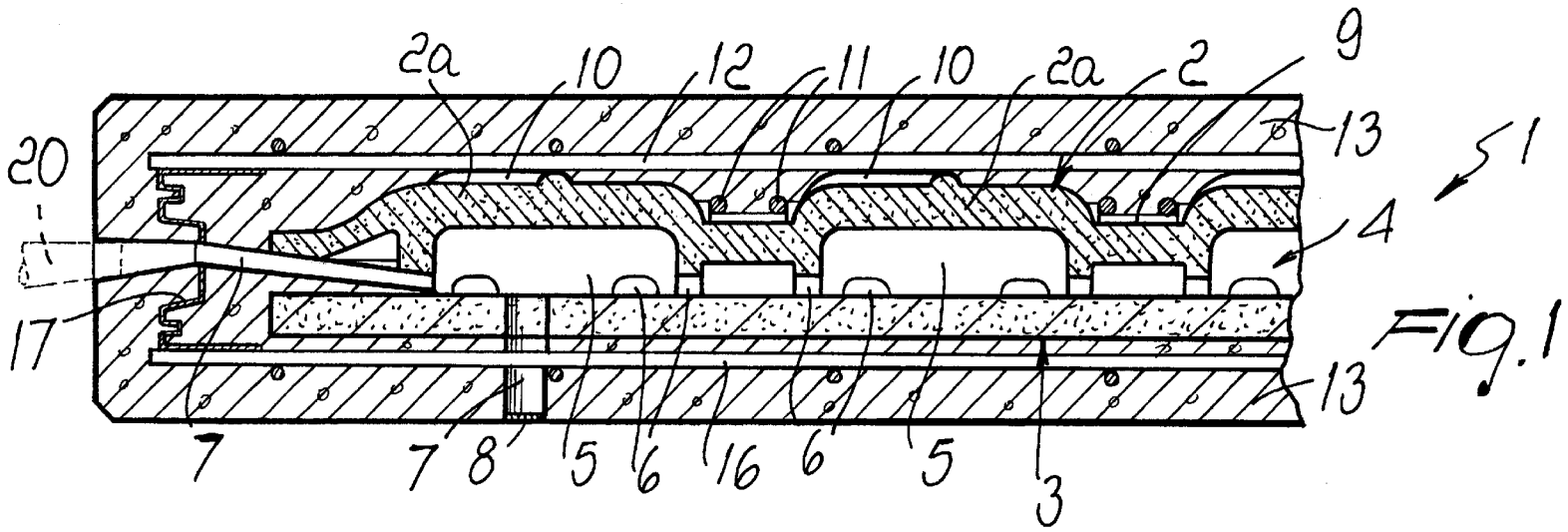
FIG. 1 is a sectional view of the panel according to the invention, taken along a plane which is perpendicular to its larger faces, the panel being shown only partially for the sake of simplicity.
Figure 6:
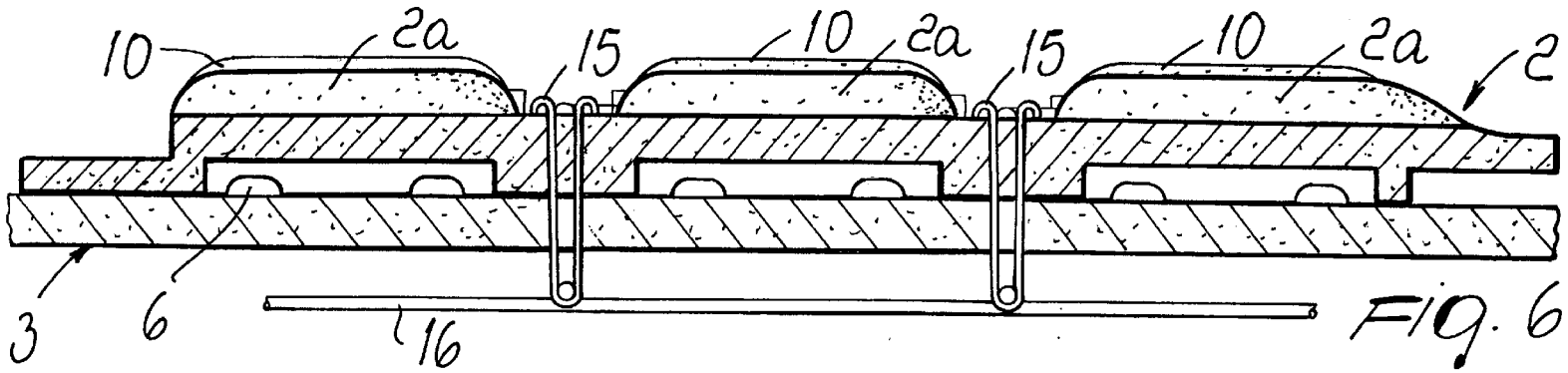
FIG. 6 is a sectional view of the two coupled sheets, taken along a plane which is perpendicular to the sectional plane of FIG. 5.
Figure 2:
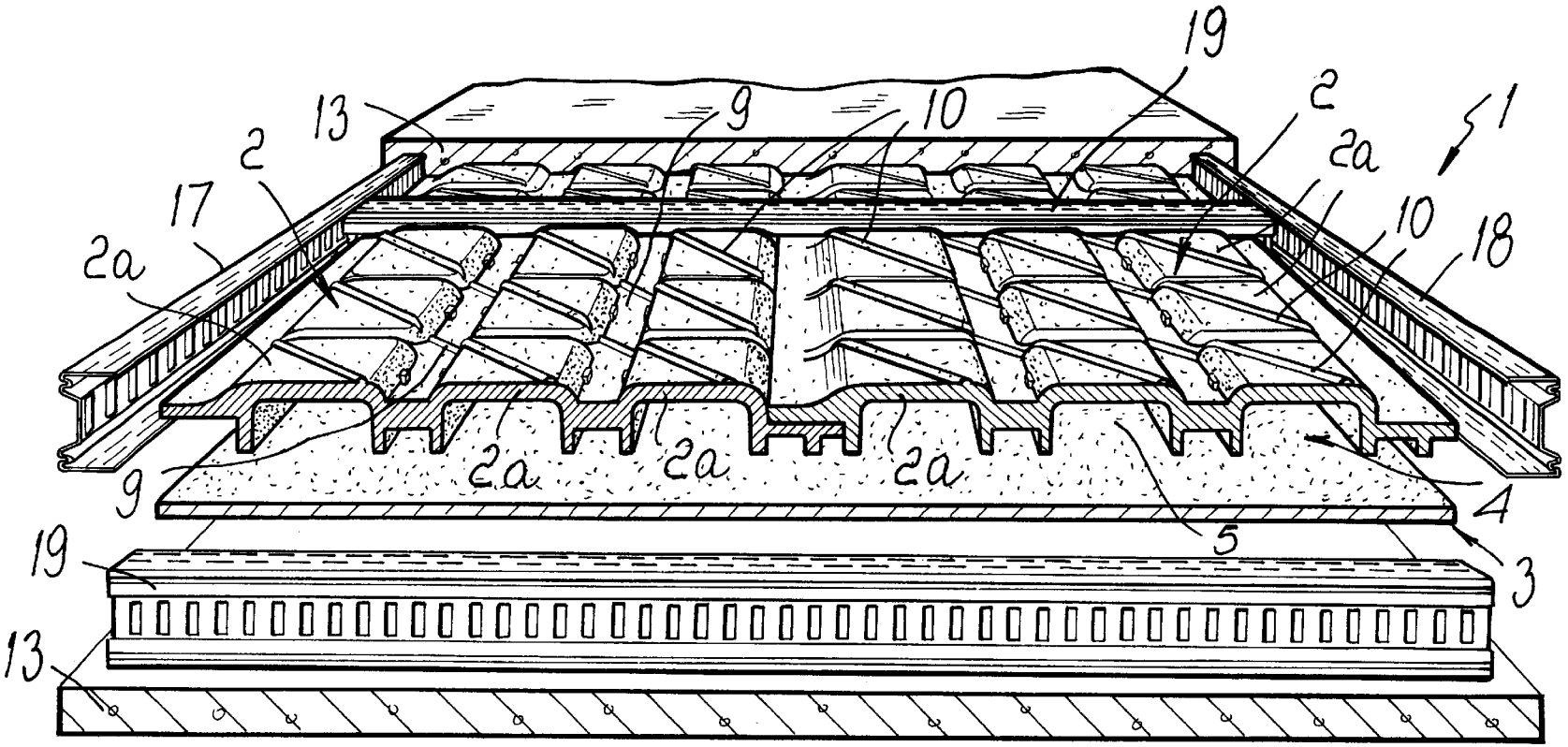
FIG. 2 is an exploded perspective view of the panel, with some elements omitted for the sake of clarity.
Figure 3:
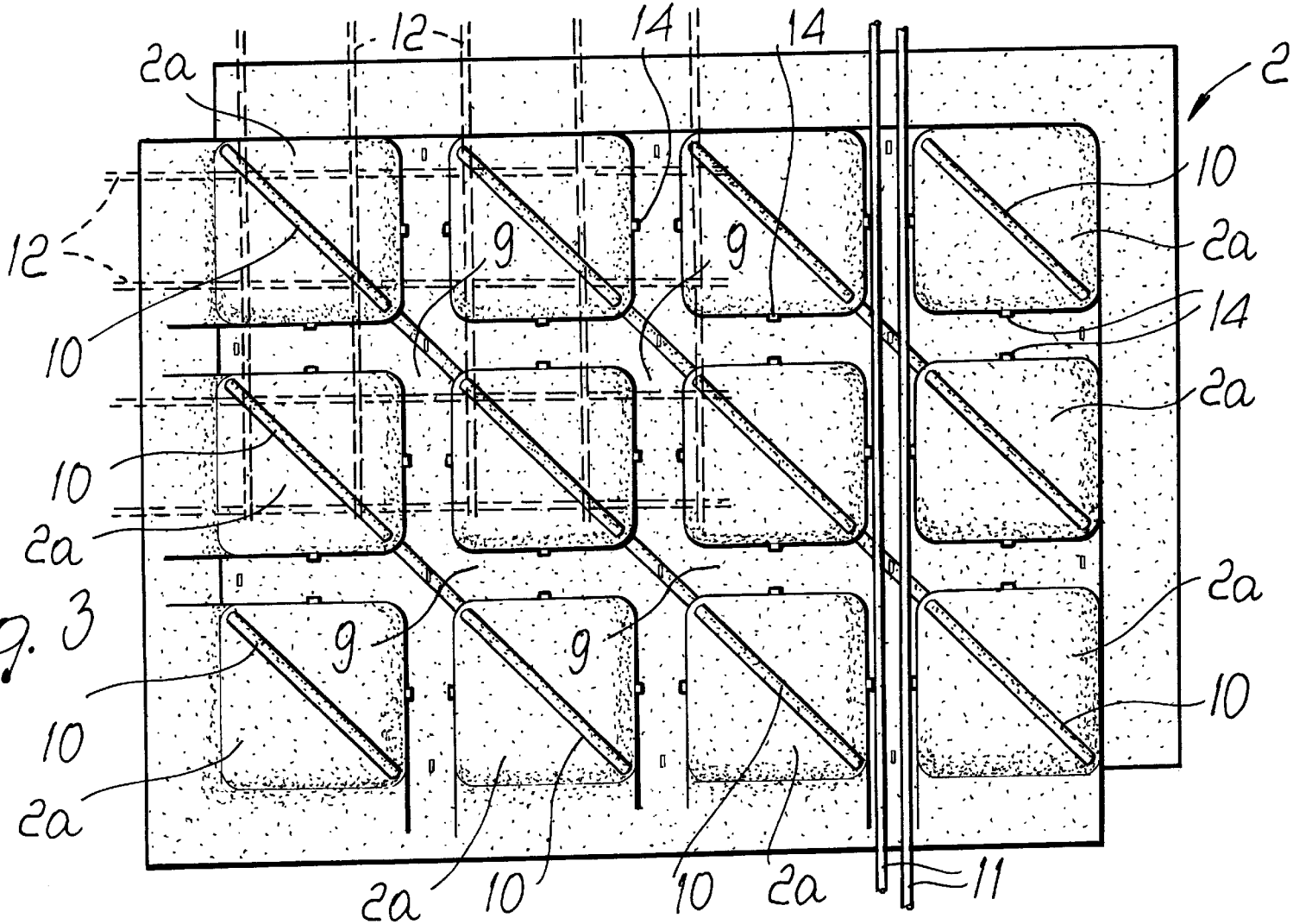
FIG. 3 is a top plan view of the first sheet, illustrating the arrangement of the net and of the bars of the reinforcement.
Figure 4:
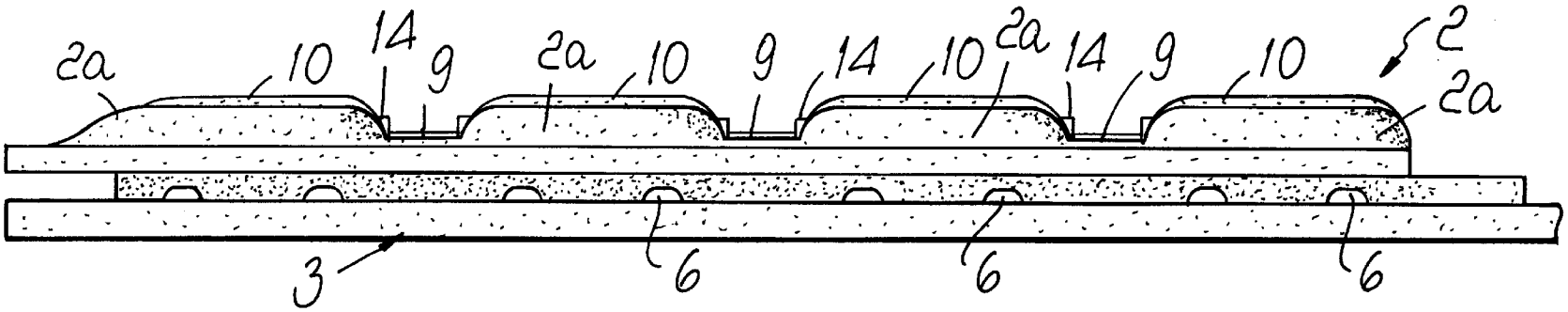
FIG. 4 is a side elevation view of the two coupled sheets.
Figure 5:
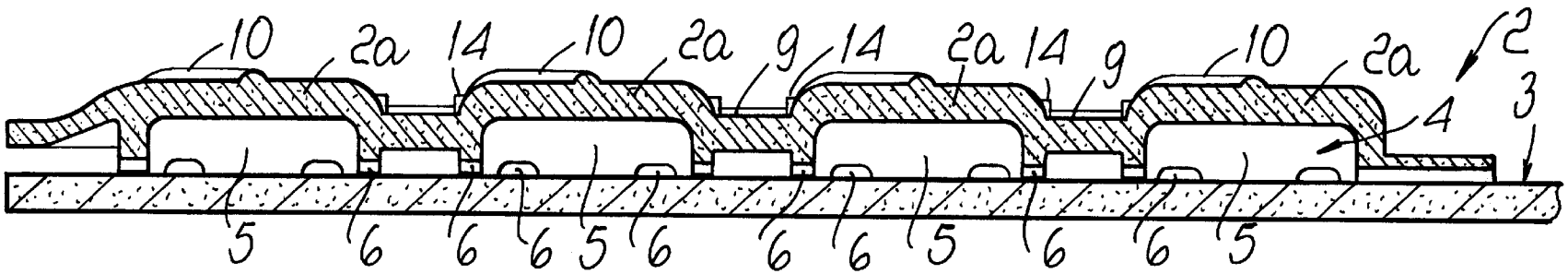
FIG. 5 is a sectional view of the two coupled sheets, taken along a plane which is perpendicular to their planes of arrangement.

With reference to the figures, the panel according to the invention, generally designated by the reference numeral 1, comprises a first sheet 2 and a second sheet 3 which are embedded in a concrete body 13 of the panel 1 and face each other on planes which are parallel to the planes of arrangement of the two larger faces of the panel 1. At least one of the sheets 2 and 3 is made of thermally insulating material, and the two sheets 2 and 3 delimit, between them, an air chamber 4 which achieves a high thermal and acoustic insulation effect for the panel.

More particularly, the first sheet 2 is preferably made of molded foamed polystyrene and is shaped like cups 2*a* which are laterally adjacent so as to obtain, on the face of the first sheet 2 that is directed toward the second sheet 3, a plurality of recesses 5 which are concave on their side directed toward the second sheet 3. The side of the recesses 5 is open, and is closed by the second sheet 3 when the two sheets 2 and 3 are assembled inside the concrete body of the panel 1.

The recesses 5 are connected one another by means of passages 6 which are formed in the edges of the cups 2*a* that are directed toward the second sheet 3.

The recesses 5 form, as a whole, the air chamber 4, and besides being connected to each other they are preferably connected to at least one ventilation duct 7 which can lead onto one of the main faces of the panel 1 and/or onto one of the lateral faces of the panel. Conveniently, on the outlets it is possible to provide suitable protective grilles 8 which are designed to prevent the infiltration of dirt or animals inside the chamber 4.

The protective grilles 8 can be provided with appropriate means for adjusting their opening which can be actuated manually or mechanically.

Advantageously, the cups 2*a*, on the face of the first sheet 2 that lies opposite with respect to the second sheet 3, are delimited by grooves 9 which are recessed with respect to the back of the cups 2*a*, which protrudes, i.e., is convex, on the face of the first sheet 2 that is directed away from the second sheet 3.

Protruding ribs 10 are formed on the back of the cups 2*a* in order to support the reinforcement bars 11 or the reinforcement net 12, embedded in the concrete body 13 of the panel.

The ribs 10 advantageously extend also inside the grooves 9 between the cups 2*a* that form the recesses 5 and diagonally with respect to the larger faces of the panel 1.

The cups 2*a* of the first sheet 2 have a substantially rectangular base and the protruding ribs 10 extend in directions which are parallel to one of the diagonals of the base of the cups 2*a*.

The ribs 10, with their particular orientation, are capable of supporting a reinforcement net 12, which is rested on the back of the cups 2*a*, so as to be spaced from the back of the cups 2*a*, thereby achieving excellent anchoring of the net 12 inside the concrete body 13 of the panel along its entire extension regardless of the size of the mesh of the net 12.

Owing to the fact that the ribs 10 also affect the inside of the grooves 9, they can have an effective supporting action for any reinforcement bars 11 arranged inside said grooves 9.

In this case also, the reinforcement bars 11 are kept correctly spaced from the bottom of the grooves 9 by the ribs 10, thus achieving excellent anchoring of the bars 11 inside the concrete 13 at the grooves 9 as well.

Moreover, it is possible to provide, inside the grooves 9, protruding teeth 14 which are connected to a peripheral side of the back of the cups 2*a* in order to facilitate the positioning of the reinforcement bars 11 and in order to keep said reinforcement bars spaced from the peripheral edge of the back of the cups 2*a* inside the grooves 9.

The second sheet 3 can simply consist of a substantially flat sheet of thermally insulating material which is preferably made of foamed polystyrene.

The sheets 2 and 3 can be preassembled, before being embedded in the concrete 13 of the panel body, by means of connecting hooks 15.

The connecting hooks 15 can also be used to rigidly couple to the sheets 2 and 3 an optional additional reinforcement net 16 which is placed on the face of the second sheet 3 that lies opposite with respect to the face that is directed toward the first sheet 2.

The panel 1 further comprises a main reinforcement constituted by a frame which is arranged externally with respect to the two sheets 2 and 3 and is composed of at least two longitudinal profiles 17 and 18, which extend along the two main sides of the panel 1 and are connected to each other by way of transverse profiles 19.

The profiles that constitute the reinforcement frame can be made of metallic or synthetic material and conveniently have perforations 20 or undulations along their extension, so as to achieve a high anchoring effect for the concrete 13.

Advantageously, the facing faces of the sheets 2 and 3 can be covered with a reflective layer which is designed to further increase the thermal insulation effect of the panel. The reflective layer can be simply constituted by a reflective coating or by a layer of aluminum or a synthetic layer, in any case of the reflective type, of reduced thickness which is applied to the mutually facing faces of the sheets 2 and 3.

Each one of the sheets 2 and 3 can be constituted by a single layer or by a is plurality of layers, possibly made of mutually different materials.

The panel according to the invention can be manufactured inside appropriate formwork by performing a first concrete casting, which constitutes one of the two faces of the panel, and by positioning on the concrete layer the two preassembled sheets 2 and 3, with the nets 12, 16 and the reinforcement bars 11 applied thereto, and the frame that constitutes the main reinforcement. Manufacture of the panel is completed by a second concrete casting which bonds with the previously performed casting, embedding the sheets 2 and 3 and the reinforcement of the panel.

During the manufacture of the panel, it is possible to arrange appropriate accessories 20 inside the formwork; such accessories are designed to be removed in order to obtain the ducts 7 that connect the air chamber 4 to the outside.

The panel is then completed by applying optional protective grilles at the outward outlets of the ducts 7.

The panel according to the invention, owing to the fact that it contains an air chamber 4 which is constituted by a plurality of mutually connected recesses 5 and is delimited by the two sheets 2 and 3, ensures a high thermal insulation effect which is greater than in currently commercially available panels.

The thermal insulation effect can be increased by the presence of the reflective covering on the mutually facing faces of the sheets 2 and 3.

The presence of the air chamber 4 inside the panel also provides an effective acoustic insulation action.

The particular configuration of the sheet 2 with grooves 9, which are recessed on its side that is directed away from the sheet 3, achieves a sort of molding of the concrete layer that covers it, forming in the concrete a network of ribs which increases the mechanical strength of the entire panel.

Moreover, because the air chamber 4 is preferably connected to the outside, air circulation is also achieved inside the chamber 4, removing and evacuating outwardly the warm air and drawing colder air from outside toward the inside of the chamber 4. Thereby migration of heat from the warmer regions of the panel toward the colder ones is achieved, causing a better distribution of the heat over the entire extension of the panel and reducing the overall temperature of the panel, with a consequent reduction of thermal expansions and therefore with savings as regards the adoption of systems for compensating for thermal expansions.

Moreover, the circulation of the air inside the chamber 4 allows to reduce moisture and thus effectively avoids condensation on the side of the panel that is directed towards the inside of the building, thus avoiding the need to provide, between the inner side of the panel and the internal space of the building, a cavity in order to remove condensation.

The presence of the ventilated air chamber 4 also allows to slow any overheating in case of fire, since the hot air and fumes produced by the fire find, in the air chamber 4 of the panel, a "stack" through which they are rapidly evacuated.

In practice it has been observed that the panel according to the invention fully achieves the intended aim and objects, since it ensures excellent thermal and/or acoustic insulation and at the same time solves the problem of thermal expansions and condensation.

Although the panel according to the invention has been conceived in particular as an infilling panel, i.e., to form outside walls of buildings, it can nonetheless have other applications.

The panel thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. MI2000A000298 from which this application claims priority are incorporated herein by reference.

What is claimed is:

1. A prefabricated concrete panel for industrialized building, with high thermal and/or acoustic insulation, comprising a first sheet and a second sheet which are embedded in a concrete body of the panel and face each other on planes which are parallel to planes of arrangement of two larger faces of the panel, at least one of said sheets being made of thermally insulating material, said sheets delimiting, therebetween an air chamber in order to increase thermal and/or acoustic insulation of the panel, said first sheet being shaped so as to form cups which are laterally adjacent to each other and delimit concave recesses on a face of said first sheet facing the second sheet, a side of said recesses that is directed toward said second sheet being closed by said second sheet and said recesses being connected to each other, wherein at least one of said first and second sheets is covered by a reflective layer on a face thereof that is directed towards the other sheet of said first and second sheets.

2. The panel according to claim 1, wherein said recesses are connected one another by means of passages which are formed in edges of said cups that are directed toward said second sheet; said recesses forming, as a whole, said air chamber and being connected to at least one ventilation duct which leads onto the outside of the concrete body of the panel.

3. The panel according to claim 2, wherein a protective grille is arranged on a outlet of said at least one ventilation duct which is directed outwards.

4. The panel according to claim 3, wherein said protective grille comprises an opening and is provided with means for adjusting said opening.

5. The panel according to claim 1, wherein said cups are delimited, on a face of said first sheet that lies opposite with respect to said second sheet, by grooves which are recessed with respect to a back of said cups, which protrudes from said face of the first sheet that is directed away from said second sheet.

6. The panel according to claim 5, wherein on the back of said cups protruding ribs are provided for supporting reinforcement bars, or a reinforcement net, embedded in the concrete body of the panel.

7. The panel according to claim 6, wherein said protruding ribs also affect said grooves between said cups.

8. The panel according to claim 6, wherein said protruding ribs extend diagonally with respect to the larger faces of the panel.

9. The panel according to claim 6, wherein said cups have a rectangular base, said protruding ribs being arranged along a diagonal of a rectangular shape of the back of said cups.

10. The panel according to claim 6, wherein said first sheet has, in said grooves, protruding teeth which are connected to a peripheral side of the edge of said cups in order to position said reinforcement bars which are embedded in the concrete body of the panel.

11. The panel according to claim 1, comprising hooks for connecting said first and second sheets one another.

12. The panel according to claim 1, comprising a main reinforcement constituted by a frame which is arranged externally with respect to said first and second sheets and is composed of at least two longitudinal profiles which extend along two main sides of the panel and are connected one another by transverse profiles.

13. The panel according to claim 12, wherein said profiles of the reinforcement frame have perforations and/or undulations for the anchoring of the concrete body of the panel.

14. The panel according to claim 1, wherein said first sheet is made of molded foamed polystyrene.

15. The panel according to claim 1, wherein said second sheet is flat.

16. The panel according to claim 1, wherein said second sheet is made of foamed polystyrene.

17. The panel according to claim 1, wherein at least one of said first and second sheets is composed of a plurality of layers.

18. The panel according to claim 1, wherein at least one of said two sheets is composed of a plurality of layers of mutually different materials.

* * * * *